US006072304A

United States Patent [19]

Duve

[11] Patent Number: 6,072,304

[45] Date of Patent: Jun. 6, 2000

[54] CIRCUIT AND METHOD FOR TRIGGERING A THYRISTOR

[75] Inventor: Jeff Duve, Efland, N.C.

[73] Assignee: Regent Lighting Corporation, Burlington, N.C.

[21] Appl. No.: 09/358,241

[22] Filed: Jul. 21, 1999

[51] Int. Cl.[7] ..... G05F 1/40; G05F 24/02

[52] U.S. Cl. ..... 323/239; 323/324; 323/905

[58] Field of Search ..... 323/237, 239, 323/905, 320, 324, 325

[56] References Cited

U.S. PATENT DOCUMENTS

| | | | |
|---|---|---|---|
| 3,746,951 | 7/1973 | Hohman | 318/221 |
| 4,307,331 | 12/1981 | Gyugyi | 323/210 |
| 4,323,793 | 4/1982 | Schutten et al. | 327/428 |
| 4,743,834 | 5/1988 | Rice | 323/239 |
| 4,805,082 | 2/1989 | Heinrich et al. | 363/129 |
| 5,204,548 | 4/1993 | Dahler et al. | 307/66 |

*Primary Examiner*—Adolf Deneke Berhane
*Assistant Examiner*—Bao Q. Vu
*Attorney, Agent, or Firm*—Niro, Scavone, Haller & Niro

[57] ABSTRACT

An improved trigger circuitry for a high side thyristor application having a thyristor connected to an A/C line, a capacitor connected across the A/C line to A/C neutral through impedance, an electronic switch connected from the thyristor to the junction of the capacitor and associate impedance. During the positive portion of the A/C cycle, the thyristor is triggered in quadrant III via the switch and the capacitor is charged. During the negative portion of the A/C cycle, the discharge of the capacitor triggers quadrant II of the thyristor via the switch.

3 Claims, 1 Drawing Sheet

CIRCUIT AND METHOD FOR TRIGGERING A THYRISTOR

BACKGROUND OF THE INVENTION

The present invention relates to a new circuit design which permits precision triggering of a thyristor in quadrants II and III. In prior art applications, a triac or thyristor is often used to perform phase control of the A/C cycle and in one common application involving outdoor electric lights, it is used to dim the light source. Most prior art applications which use thyristors to dim a light source typically trigger a thyristor in a high side configuration in quadrants I and IV. However, triggering the thyristor in quadrant IV presents many design compromises.

First, in order to trigger quadrant IV, it is well known that additional power is needed to do so. As is stated in the Treccor Electronic Catalog at Pages 133–136, which is herein incorporated by reference, typically twice as much power is needed to trigger quadrant IV as compared with quadrants I–III. Moreover, as the temperature drops, the power required to trigger the thyristor in quadrant IV increases. Often, in outdoor lighting applications, once the outside temperature reaches 0° C. to −20° C., the power supply of the lighting device is often incapable of supplying the power needed to trigger quadrant IV of the triac, which results in the device shutting down.

To overcome this problem, outdoor lighting products may use larger power supplies but this increases the cost of the unit and increases the operating temperature. On the other hand, some manufacturers accept this limitation with the knowledge that at low temperatures their units will cease functioning. Consequently, there is a need for circuitry which will enable a thyristor to be triggered in quadrants II and III with their associated lower power requirements and increased temperature tolerance.

SUMMARY OF THE INVENTION

The present invention solves the above mentioned design problems by providing circuitry which permits a thyristor to be triggered in quadrants II and III. To do this, the circuitry of the present invention uses an A/C line to trigger quadrant III of a thyristor and to charge a capacitor during the positive phase of the A/C cycle. During the negative phase, the circuitry is designed to use the discharge of the capacitor to trigger quadrant II of the thyristor. Configuring the circuit in this manner permits a thyristor to be used without the need to use quadrant IV and its increased power requirements.

BRIEF DESCRIPTION OF THE DRAWINGS

The novel features which are characteristic of the present invention are set forth in the appended claims. The invention itself, however, together with further objects and attendant advantages, will be best understood by reference to the following description taken in connection with the accompanying drawings in which:

DETAILED DESCRIPTION OF THE PREFERRED EMBODIMENTS

Figure 1:
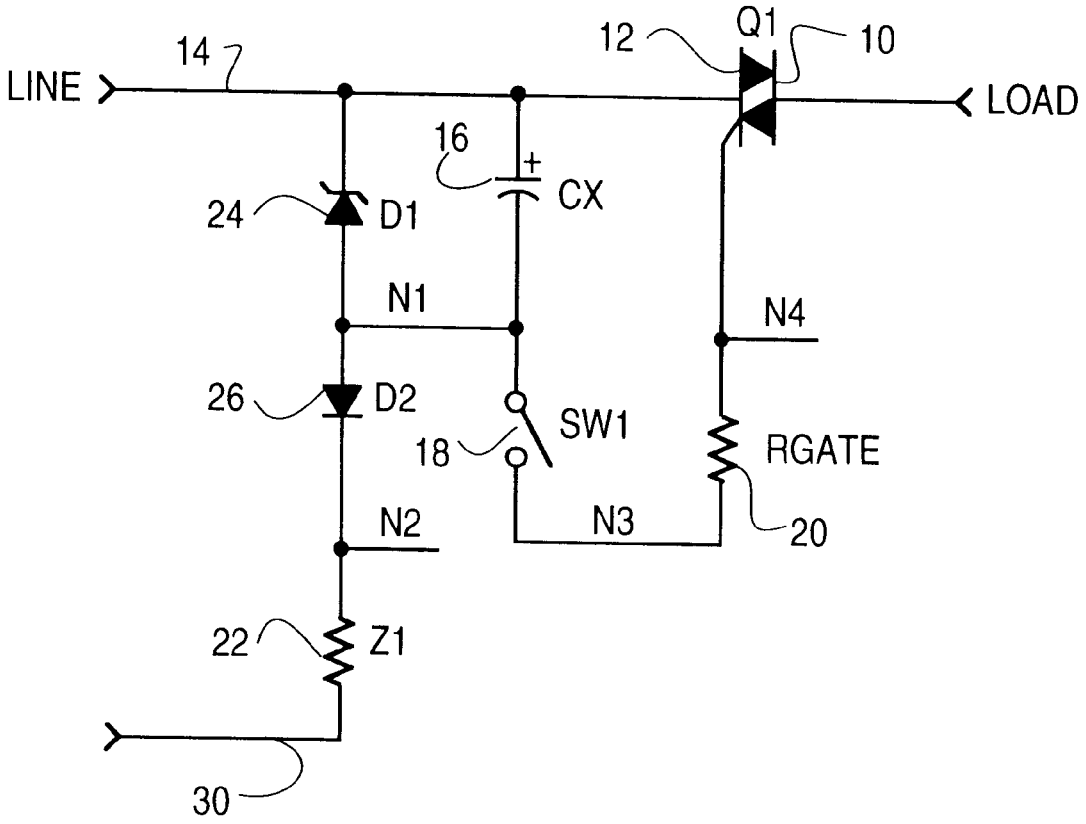
FIG. 1 is a block diagram showing the circuitry of the present invention.

Set forth below is a description of what is currently believed to be the preferred embodiment or best example of the invention claimed. Future and present alternatives and modifications to the preferred embodiment are contemplated. Any alternates or modifications in which insubstantial changes in function, purpose, structure or result are intended to be covered by the claims of this patent.

FIG. 1 shows a preferred embodiment of the present invention in which circuit 10 is used to trigger a thyristor or triac 12 in quadrants II and III in a high side configuration. As shown, a power line 14 is connected to quadrant III of triac 12. Power line 14 is also used to charge capacitor 16. Capacitor 16 is also connected to electronic switch 18 which is operable by a microprocessor or logic device. In addition, resistors 21 and 22 and diodes 24 may be used for the protection of the circuitry. Diode 26 is provided to block the discharge of capacitor 16 during the negative phase of the A/C cycle. Lastly, as shown, capacitor 16 is connected across A/C line 14 through impedance with neutral line 30.

In operation, during the positive portion of the A/C cycle with switch 18 closed, thyristor 12 is triggered in quadrant III by power line 14. In addition, capacitor 18 is being charged as well. During the negative phase of the A/C cycle, when switch 18 remains closed, the discharge from capacitor 16 is used to trigger quadrant II of thyristor 12.

When the switch 18 is in an open position, capacitor 16 is charged, but the thyristor is not triggered. As will be known to those of ordinary skill in the art, electronic switch 18 may be operated by a microprocessor which controls the timing and operation of the switch.

Once thyristor 12 is triggered, it may be used to phase control the A/C cycle. In lighting applications, this is commonly used to dim the brightness of a light or lamp.

Configuring the circuitry for triggering thyristor 12 as described above, provides several advantages. First, it permits the thyristor to be triggered through use of quadrants II and III. Another result of the present circuitry is that it allows for precise triggering of the thyristor. Since switch 18 is operable by a microprocessor, it may be used to trigger the thyristor in a predetermined manner. For example, when the switch is closed and the A/C cycle is in the positive phase, power will be supplied to quadrant III of thyristor 12 to trigger the thyristor. When switch 18 is open, no triggering occurs. Thus, by using the microprocessor to open and close the switch as desired, power may be supplied to quadrant III at any point in the positive phase of the A/C cycle. Moreover, by opening and closing the switch multiple times, multiple triggering pulses may be used to trigger the thyristor which is a known way to lower the power needed to trigger the thyristor and to reduce associated electromagnetic interference (EMI).

The same is also true for triggering quadrant II of the thyristor during the negative phase of the A/C cycle. As described above, when switch 18 is open, quadrant II will not be triggered. To cause triggering, the switch must be closed. Thus, using the microprocessor to control the opening and closing of switch 18, also allows the triggering of quadrant II to be controlled as well in the same manner described above.

It should be understood that various changes and modifications to the preferred embodiment described would be apparent to those skilled in the art. Changes and modifications can be made without departing from the spirit and scope of the present invention and without diminishing its intended advantages. It is, therefore, intended that such changes and modifications be covered by the following claims.

What is claimed is:

1. A method of triggering a thyristor in a high side configuration, comprising:

using a power line to trigger quadrant III of said thyristor;

using said power line to charge a capacitor; and using said capacitor to trigger quadrant II of said thyristor.

2. An improved circuit for triggering a thyristor in a high side configuration, using quadrants II and III, comprising:

a power source, a capacitor, and an electronic switch; said power source configured to trigger quadrant III of said thyristor through said switch and to charge said capacitor; and using said switch to trigger quadrant II of said thyristor through discharge of said capacitor.

3. Improved trigger circuitry for high side thyristor application, comprising:

a thyristor connected to an A/C line;

a capacitor connected across the A/C line to A/C neutral through impedance;

an electronic switch connected from said thyristor to the junction of said capacitor and associate impedance;

during positive portion of the A/C cycle, the thyristor is triggered in quadrant III via the switch and capacitor is charged; and during negative portion of the A/C cycle, the discharge of the capacitor triggers quadrant II of the thyristor via the switch.

* * * * *